US006422890B1

(12) United States Patent
Marchini et al.

(10) Patent No.: US 6,422,890 B1
(45) Date of Patent: Jul. 23, 2002

(54) ELECTRICAL ASSEMBLIES

(75) Inventors: Barry Allen Marchini, West Sussex; Anthony Michael Jeffs, Surrey; John Leonard Scriven, Bromley, all of (GB)

(73) Assignee: Starpoint Electrics Limited, Surrey (GB)

( * ) Notice: Subject to any disclaimer, the term of this patent is extended or adjusted under 35 U.S.C. 154(b) by 0 days.

(21) Appl. No.: 09/269,892

(22) PCT Filed: Oct. 9, 1997

(86) PCT No.: PCT/GB97/02773

§ 371 (c)(1),
(2), (4) Date: Jun. 7, 1999

(87) PCT Pub. No.: WO98/15992

PCT Pub. Date: Apr. 16, 1998

(30) Foreign Application Priority Data

| | | |
|---|---|---|
| Oct. 9, 1996 | (GB) | 9621065 |
| Dec. 9, 1996 | (GB) | 9625511 |
| Feb. 24, 1997 | (GB) | 9703775 |

(51) Int. Cl.[7] ..... H01R 13/627
(52) U.S. Cl. ..... 439/358; 439/188; 200/51.09
(58) Field of Search ..... 439/188, 352, 439/358, 489; 200/51.09, 51.1

(56) References Cited

U.S. PATENT DOCUMENTS

| | | | | |
|---|---|---|---|---|
| 4,192,568 A | | 3/1980 | Marks et al. | |
| 5,015,200 A | | 5/1991 | Abernethy | 439/357 |
| 5,275,575 A | * | 1/1994 | Cahaly et al. | 439/188 |
| 5,277,602 A | * | 1/1994 | Yi | 439/188 |
| 5,391,087 A | * | 2/1995 | Fukuda | 439/188 |
| 5,449,298 A | * | 9/1995 | Fetterolf, Sr. | 439/352 |
| 5,653,606 A | * | 8/1997 | Chrysostomou | 439/188 |
| 5,672,071 A | * | 9/1997 | Ceru | 439/352 |
| 5,702,266 A | * | 12/1997 | Jones | 439/352 |
| 5,993,230 A | * | 11/1999 | Gauker et al. | 439/188 |

FOREIGN PATENT DOCUMENTS

| | | |
|---|---|---|
| DE | 38 37 653 A1 | 5/1989 |
| EP | 0 342 703 A2 | 11/1989 |
| GB | 2 279 500 A | 1/1995 |
| WO | WO 97/23934 | 7/1997 |

* cited by examiner

*Primary Examiner*—Hien Vu
(74) *Attorney, Agent, or Firm*—Sughrue Mion, :LLC

(57) ABSTRACT

An electrical assembly has first and second initially separated connection portions, of which the first is adapted to be secured to a first component, such as a microswitch, and the second is adapted to be secured to a second component, such as electrical wiring through insulation displacement, with the first and second connection portions further being capable of releasably fitting together, such as by means of a latch to bring the first and second components into electrical contact.

10 Claims, 5 Drawing Sheets

14a
42a
72a
70a
72a
88a
82a
90a
60a
84a
24a
68a
62a
20a
66a
26a
18a
64a
74a
12a
34a
80a
10a
78a
76a

ELECTRICAL ASSEMBLIES

BACKGROUND OF THE INVENTION

The present invention relates generally to electrical assemblies and is more especially but not exclusively concerned with electrical assemblies of the kind found in fruit machines.

It is well known for fruit machines to be provided with controls for operation by players of the fruit machines.

Typically, the controls are in the form of push-buttons provided with respective microswitches which are themselves provided with respective series of blade contacts to which electrical wiring is to be secured to permit operation of the fruit machines.

Examples of known push-button switches are to be found in GB-A-2279500 to which the reader is invited to refer.

A particular problem with push-button switches for fruit machines, but a problem which is also experienced by other electrical assemblies, is that it is commercially desirable for fitting the push-button switches in the fruit machines to be as quick as possible, thus enabling the periods when the fruit machines are out of operation to be as short as possible.

In practical terms, this means that fastening the push-button switches to the fruit machines, and fastening the electrical wiring to the push-button switches, must be such that the fastening operations can be performed easily and reliably even by unskilled servicing personnel.

WO 97/23934 discloses, inter alia, how a push-button switch can be quickly secured to a fruit machine.

It involves the use of a stud-like member having a ribbed portion and a non-ribbed portion, and a nut-like member having a projecting portion which is capable of moving along the stud-like member in the non-ribbed portion thereof and is capable of moving across the stud-like member in the ribbed portion thereof.

The ribbed portion can be in the form of a helically advancing thread or a series of transversely extending serrations.

Our present patent application is concerned, inter alia, with how electrical wiring can be quickly secured to a push-button switch.

SUMMARY OF THE INVENTION

According to the present invention, an electrical assembly comprises first and second initially separated connection portions of which the first is adapted to be secured to a first component and the second is adapted to be secured to a second component with the first and second connection portions further being capable of releasably fitting together to bring the first and second components into electrical contact.

Preferably, the first connection portion is adapted to be secured to the first component as a snap fit, the first connection portion is formed of a resiliently deformable plastics material and the first connection portion is provided with a plurality of studs intended for location in corresponding holes provided in the first component.

Preferably, the second connection portion is adapted to be secured to the second component by way of insulation displacement, the second connection portion includes a housing of plastics material and the second connection portion is provided with a plurality of electrical terminals which are electrically insulated from one another, are accessible through associated slots in the housing and are intended for electrical contact with corresponding electrical terminals provided by the first component.

Latch means may be provided to permit the releasable fitting together of the first and second components.

In one embodiment, the second connection portion is formed with at least one resiliently deflectable leg having a latching shoulder near one end thereof which is capable of snap engaging with an associated latching surface formed on the first connection portion, and there may be two of said legs, and two of said latching shoulders, release of said legs being achieved by manipulation of those ends of said legs remote from said latching shoulders.

In another embodiment, the first connection portion is formed with at least one resiliently deflectable leg having a latching shoulder near one end thereof which is capable of snap engaging with an associated latching surface formed on the second connection portion, and there may be two of said legs, and two of said latching shoulders, release of said legs being achieved by manipulation of a further pair of resiliently deflectable legs provided by the second connection portion.

In a preferred electrical assembly, the first connection portion is secured to a microswitch constituting the first component, and the second connection portion is secured to electrical wiring constituting the second component.

In such a preferred electrical assembly, the first connection portion may be operatively secured to a reciprocally movable push-button, operation of the push-button may cause an actuating bar to actuate the microswitch and the actuating bar may bridge a pair of reciprocally movable legs projecting from the push-button.

Preferably, the microswitch does not project laterally outwardly of the first connection portion thereby enabling the microswitch to be secured to the first connection portion before the first connection portion is itself pushed through an apertured panel.

Said first connection portion may be associated with blade contacts for a lamp, or two lamps if there is to be dual illumination, particularly if the electrical assembly forms part of a push-button switch.

Said first connection portion may be provided integrally with, or attached to, a nut-like member of the kind disclosed in said WO 97/23934, particularly if the electrical assembly forms part of a quick-fit fastener in a push-button switch.

It should also be noted that said first connection portion may be dimensioned to be small enough to fit through an existing hole in a panel in a fruit machine, even when secured to a microswitch, and that said second connection portion may be configured to fit with said first connection portion in only a single permitted orientation.

A particular advantage of said first connection portion being dimensioned to be small enough to fit through an existing hole in a panel of a fruit machine, even when secured to a microswitch, is that the electrical circuitry of said first connection portion including the microswitch can be fully factory tested before sale.

Electrical assemblies, in accordance with the present invention, will now be described in greater detail, by way of example only, with reference to the accompanying drawings, in which:

DETAILED DESCRIPTION OF THE PREFERRED EMBODIMENTS

Figure 1:
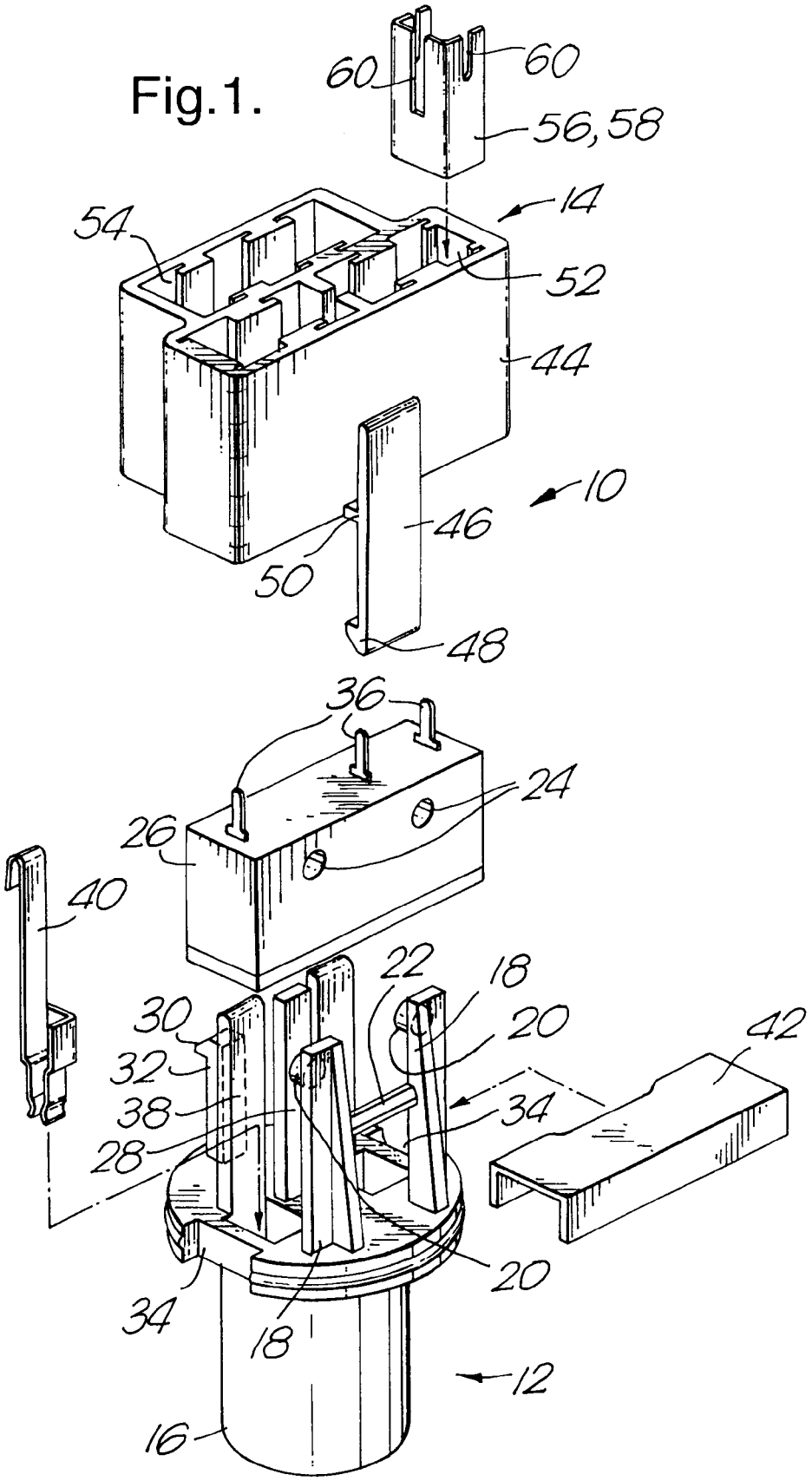
FIG. 1 is an exploded schematic perspective view of a first electrical assembly of the present invention, from which various features have been omitted in the interest of clarity.
Figure 2:
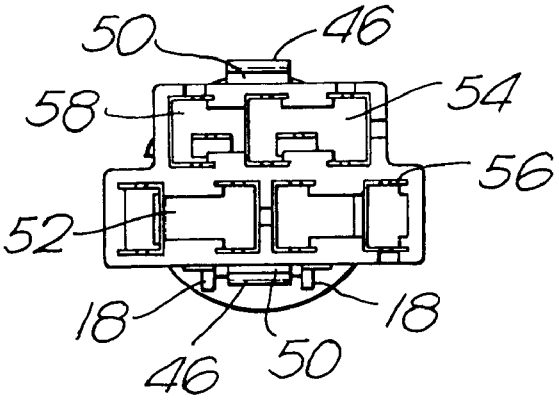
FIGS. 2, 3, 4 and 5 are respectively plan, left side, right side and sectional views of the electrical assembly shown in FIG. 1.
Figure 3:
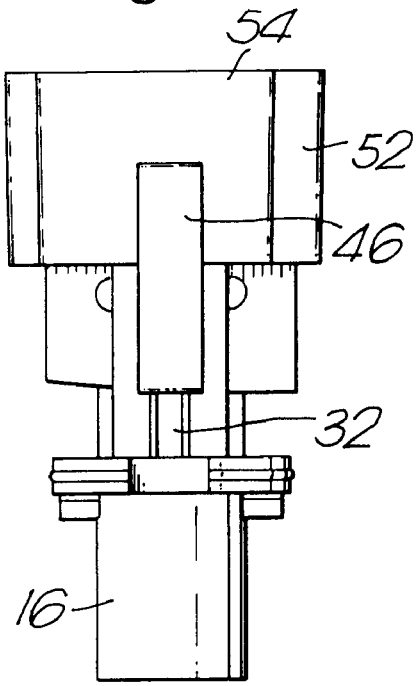
Figure 4:
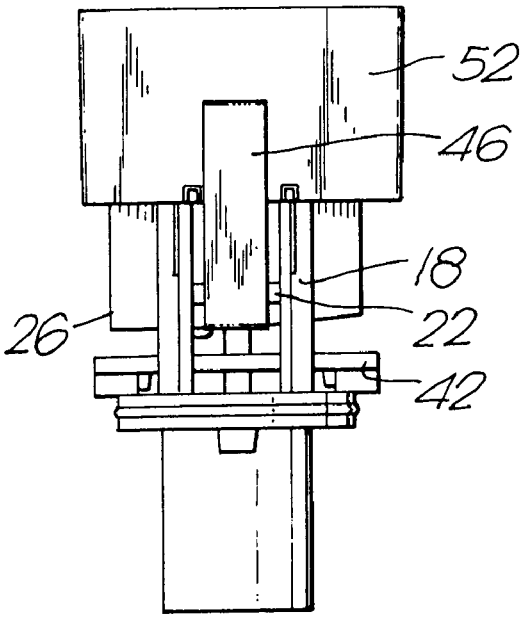
Figure 5:
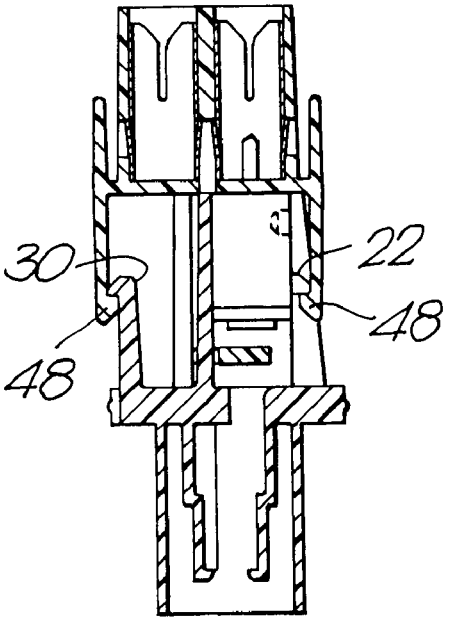
Figure 6:
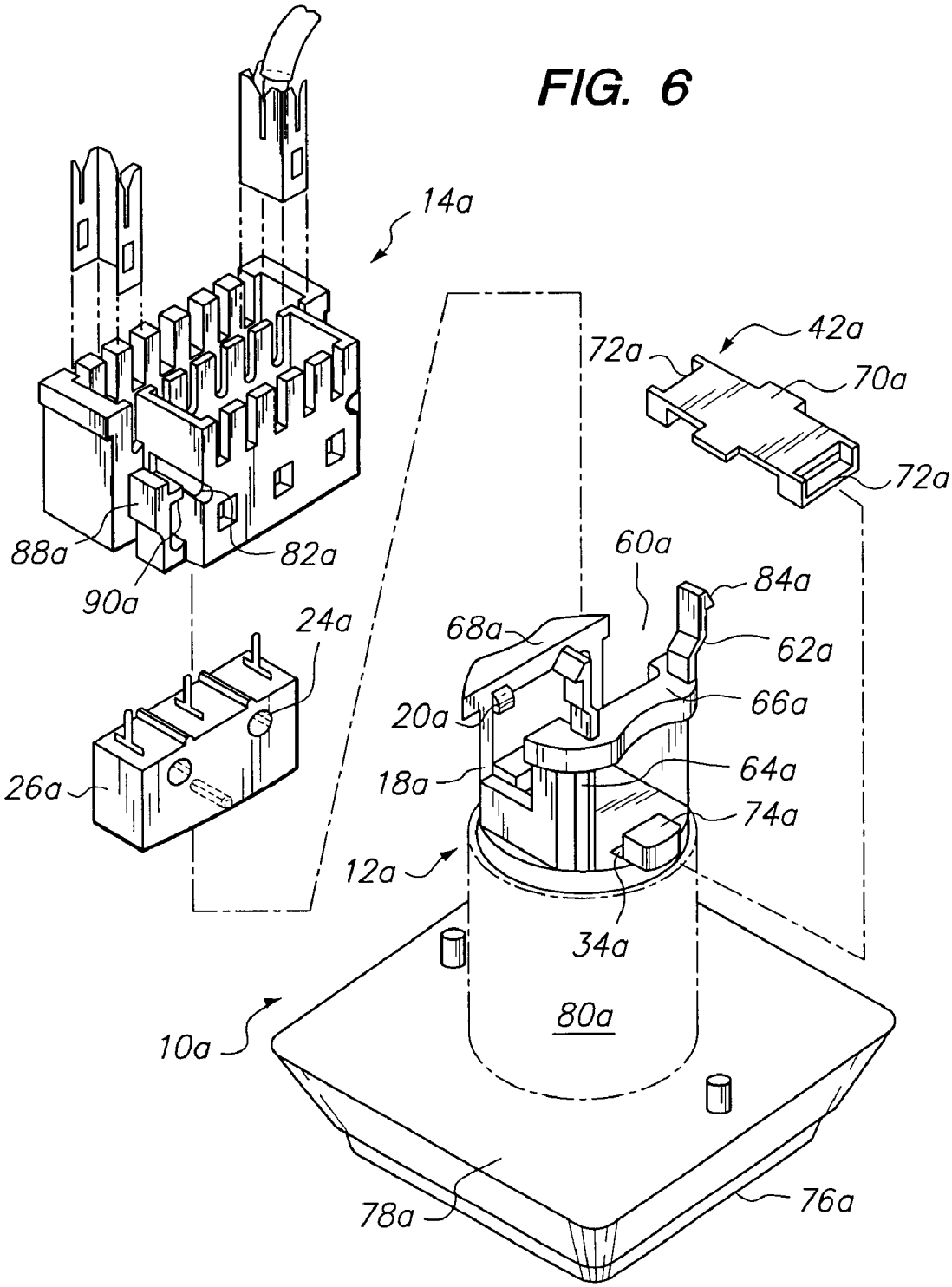
FIG. 6 is an exploded schematic perspective view of a second electrical assembly of the present invention, illustrating several modifications.
Figure 7:
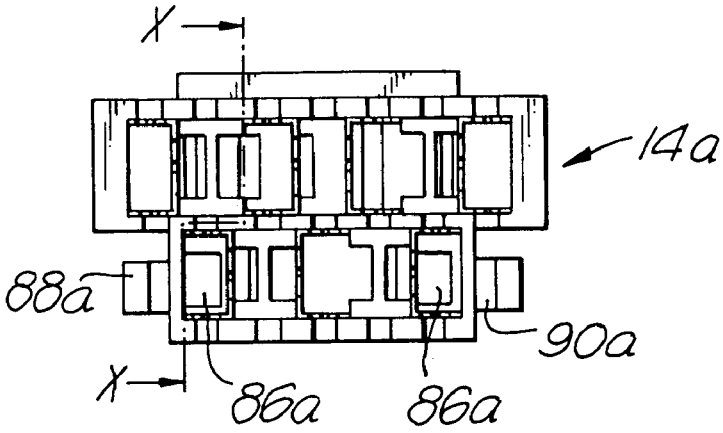
FIGS. 7, 8, 9 and 10 are respectively plan, rear, section on line X—X and underplan views of just one of the two connection portions shown in FIG. 6.
Figure 8:
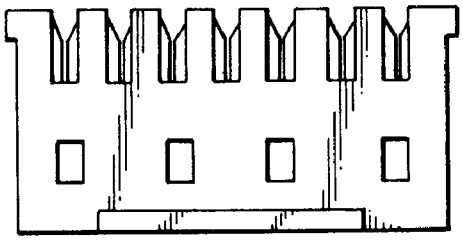
Figure 9:
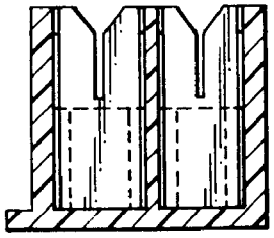
Figure 10:
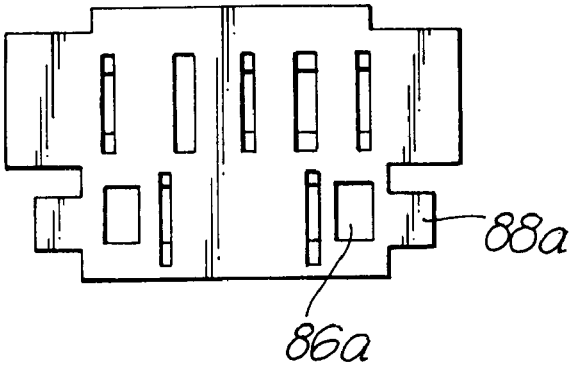

A first electrical assembly 10 according to the present invention, as shown in FIGS. 1 to 5, comprises two initially separated connection portions 12, 14 of which the connection portion 12 is adapted to be secured to a first component (microswitch) and the other connection portion 14 is adapted to be secured to a second component (electrical wiring) with the two connection portions 12, 14 further being capable of releasably fitting together to bring the wiring into electrical contact with the microswitch.

The connection portion 12 is formed in one piece of a plastics material and presents a body 16.

The body 16 may be inserted in, or integrally formed with, an externally threaded cylinder of a conventional push-button switch or may be attached to, or integrally formed with, a nut-like member of a quick-fit fastener of the kind referred to hereinbefore.

The body 16 has a pair of stiff support legs 18 extending therefrom, each of the support legs 18 being formed with a locating stud 20 and the support legs 18 being joined by a central strut 22. The purpose of the studs 20 is to locate within complementary holes 24 provided in a side face of a microswitch 26. The other side face of the microswitch 26 is engaged by a resiliently flexible support leg 28 which continuously presses the microswitch 26 towards the support legs 18. The central strut 22 presents a latching surface, for a purpose to be set forth hereinafter, and a latching shoulder is presented by a barb 30 at a free end of a resiliently deflectable leg 32.

It will be appreciated that, in a manner which is generally conventional, the lower end face of the microswitch 26 (as shown in the exploded view) is formed with a button. The button is pressed when a pivotable arm (not shown) of the microswitch 26 is lifted upwardly by a part of a push-button switch (not shown) which protrudes through an opening 34. The upper end face of the microswitch 26 (as shown in the exploded view) is formed with a row of three blade contacts 36.

The body 16 may have a pair of stiff support legs 38, only one shown, which provide support for a pair of lamp terminals 40.

Moreover, the body 16 may have an opposed pair of the openings 34, both are shown, which receive an opposed pair of legs reciprocably movable when the push-button switch is operated, and an actuating bar 42 may extend between the legs to actuate the button on the microswitch 26 directly, thus enabling the pivotable arm on the microswitch 26 to be omitted.

The connection portion 14 is again formed in one piece of a plastics material and presents a housing 44.

The housing 44 is formed externally with a pair of resiliently deflectable legs 46, each of which is formed at its free end with a barb 48 presenting a latching shoulder, and each of which is secured to the housing 44 by a short strut 50. The housing 44 is formed internally with a pair of compartments 52, 54 with the larger compartment 52 including wire terminals 56 and the smaller compartment 54 including wire terminals 58. All of the wire terminals 56, 58 are provided with various slots 60 allowing individual wires to be easily connected thereto by displacement of the insulation around the wires.

The housing 44 would itself be provided with opposed pairs of slots (not shown) and indeed as is typical for IDC connectors the opposed pairs of slots in the housing 44 would preferably include resilient barbs (not shown) for resisting inadvertent removal of wiring which had been brought into electrical contact with the wire terminals 56, 58.

When fitted together, one of the barbs 48 snaps into engagement with the latching surface presented by the central strut 22, whereas the other of the barbs 48 snaps into engagement with the latching shoulder presented by the barb 30.

At this time, the three blade contacts 36 projecting from the microswitch 26 are inserted through complementary slots formed in the bottom of the larger compartment 52 and the lamp terminals 40 are inserted through a complementary pair of slots formed in the bottom of the smaller compartment 54 into electrical contact with the terminals 56 and 58.

A second electrical assembly 10*a* according to the present invention is shown in FIGS. 6 to 10—the overall height is considerably reduced but the manner of operation of the electrical assembly 10*a* is substantially the same as already described with reference to the electrical assembly 10.

Indeed, many of the constructional features of the electrical assembly 10*a* are either the same as or very similar to the corresponding constructional features of the electrical assembly 10.

The connection portion 12*a* has a channel 60*a* extending at right angles to the line joining opposed openings 34*a*. The microswitch 26*a* is received in the channel 60*a* with holes 24*a* in the microswitch 26*a* locating with studs 20*a* presented by support legs 18*a*. The studs 20*a* can be of a ramped outline to facilitate entry of the microswitch 26*a* into the channel 60*a* but to resist withdrawal of the microswitch 26*a* from the channel 60*a*. A pair of resiliently deflectable legs 62*a* are carried by respective ones of a pair of support legs 64*a* which are joined by a strut 66*a* in opposition to a strut 68*a* joining the support legs 18*a*. The purpose of the resiliently deflectable legs 62*a* is to allow the connection portion 12*a* to latch into engagement with the connection portion 14*a*.

An actuating bar 42*a* is of a cross or plus shape, with each of its central lugs 70*a* fitting between one of the support legs 18*a* and one of the support legs 64*a*, and with each of its end lugs being formed with a recess 72*a*—in use, the bar 42*a* is inverted so that the recesses 72*a* receive respective ones of a pair of reciprocable legs 74*a* projecting through the openings 34*a*, the legs 74*a* forming part of a push-button switch having a button 76*a* which is reciprocable relatively to a housing 78*a* and a cylinder 80*a* (shown in phantom).

The connection portion 14*a* here includes a pair of slots 82*a* for engagement by barbs 84*a* formed at the free ends of the resiliently deflectable legs 62*a*. The barbs 84*a* enter the connection portion 14*a* through respective holes 86*a*. The connection portion 14*a* also includes another pair of resiliently deflectable legs 88*a* having projections 90*a* which are operable when squeezed towards one another to push the barbs 84*a* out from engagement with the slots 82*a*.

It will be appreciated that FIGS. 6 to 10 are schematic in that only a microswitch has been indicated whereas in practice there would also be a lamp to be brought into electrical contact with electrical wiring—the electrical contact can be equivalent to that between the microswitch and the electrical wiring by involving blade contacts associated with the lamp which engage IDC contacts associated with the electrical wiring.

Figure 11:
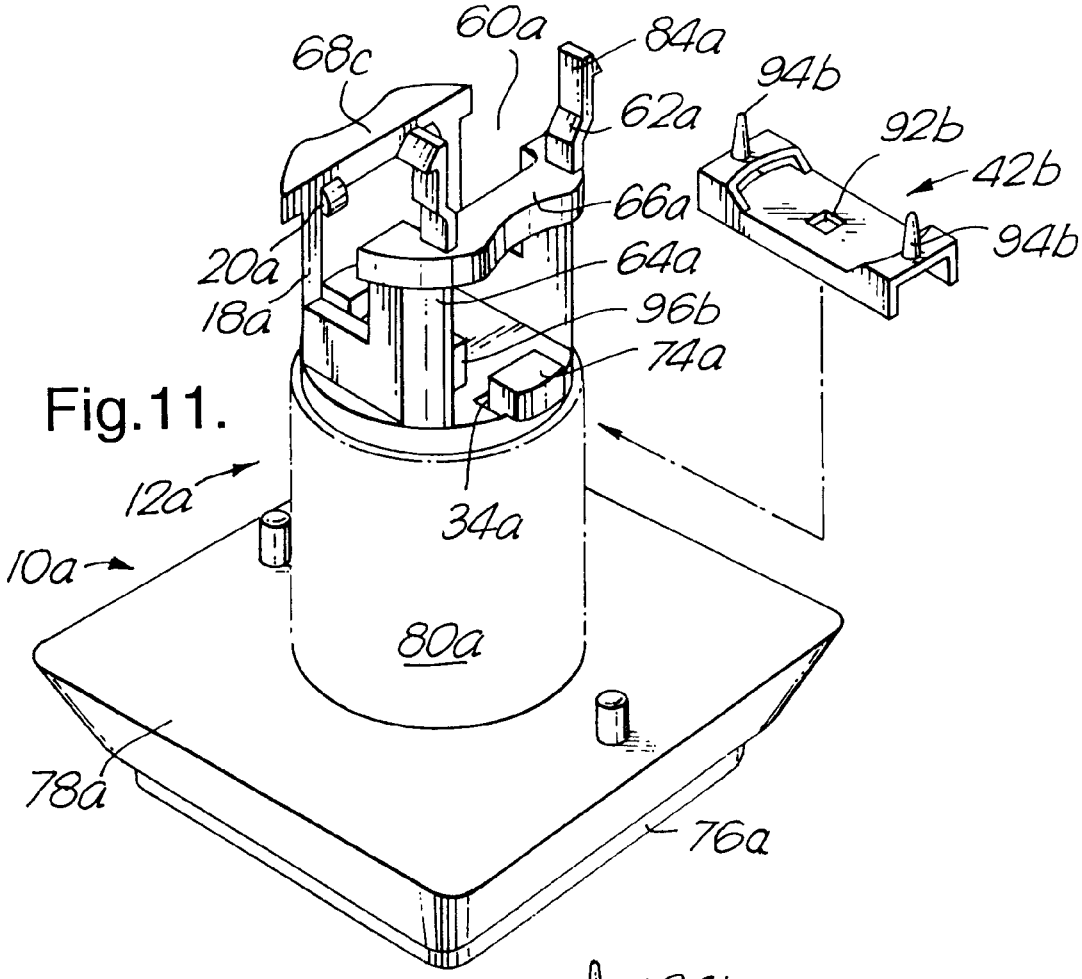
FIG. 11 is similar to FIG. 6, but illustrating a modified actuating bar.
Figure 12:
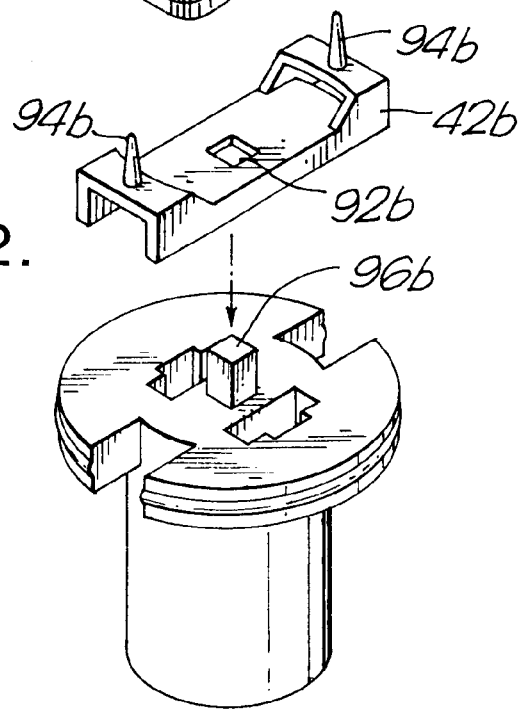
FIG. 12 is an enlarged exploded schematic perspective view of parts of FIG. 11.

With reference now to FIGS. 11 and 12, it will be seen that the previously disclosed actuating bars 42 and 42*a* have been replaced by an actuating bar 42*b* which serves the same purpose in acting as a bridge to actuate a button on a microswitch when a push-button switch is operated.

Here, the bar 42*b* is provided with a central rectangular aperture 92*b* and/or a pair of end retaining projections 94*b*. The aperture 92*b* is intended to locate with a complementary locating peg 96*b* extending from one end of the lamp holder body. Similarly, the projections 94*b* are intended to locate against the sides of the microswitch to hold the bar 42*b* in position.

It should be noted that the aperture 92*b* and the peg 96*b* can be reversed so that the peg 96*b* extends from the bar 42*b* and the aperture 92*b* is formed in the lamp holder body.

It should also be noted that the aperture 92*b* and the peg 96*b* need not necessarily be rectangular, in cross-section, but are merely preferably of non-circular outline to resist swivel therebetween.

In all other respects, the manner of operation of the electrical assembly of the invention has remained unchanged.

We claim:

1. An electrical assembly comprising first and second initially separated connection portions, of which the first connection portion is secured to a microswitch and the second connection portion is secured to electrical wiring, with the first and second connection portions being capable of bringing the microswitch into electrical contact with the electrical wiring;

wherein latch means is provided to permit the first and second connection portions to be releasably secured to one another, the first connection portion being formed with two first resiliently deflectable legs, each having a latching shoulder near one end thereof which is capable of snap engagement with a respective latching surface formed on the second connection portion, and the second connection portion having a second pair of resiliently deflectable legs including projection, which are movable towards and away from said latching surfaces, said fist resiliently deflectable legs being released by squeezing said second pair of resiliently deflectable legs whereby said projections contact said first resiliently deflectable legs to push the latching shoulders out of engagement with the latching surfaces.

2. An electrical assembly according to claim 1, wherein the first connection portion is formed of a resiliently deformable plastics material.

3. An electrical assembly according to claim 2, wherein the first connection portion is provided with a plurality of studs which locate in corresponding holes provided in the microswitch.

4. An electrical assembly according to claim 1, wherein the second connection portion is secured to the electrical wiring by way of insulation displacement.

5. An electrical assembly according to claim 4, wherein the second connection portion includes a housing of plastics material.

6. An electrical assembly according to claim 5, wherein the second connection portion is provided with a plurality of electrical terminals which are electrically insulated from one another, are accessible through associated slots in the housing and are intended for electrical contact with corresponding electrical terminals provided by the microswitch.

7. An electrical assembly according to claim 1, wherein the first connection portion is operatively secured to a reciprocally movable push-button.

8. An electrical assembly according to claim 7, wherein operation of the push-button causes an actuating bar to actuate the microswitch.

9. An electrical assembly according to claim 8, wherein the actuating bar bridges a pair of reciprocally movable legs projecting from the push-button.

10. An electrical assembly according to claim 1, wherein the microswitch does not project laterally outwardly of the first connection portion thereby enabling the microswitch to be secured to the first connection portion before the first connection portion is itself pushed through an aperture panel.

* * * * *